United States Patent [19]

Kalnes et al.

[11] Patent Number: 4,882,037

[45] Date of Patent: Nov. 21, 1989

[54] PROCESS FOR TREATING A TEMPERATURE-SENSITIVE HYDROCARBONACEOUS STREAM CONTAINING A NON-DISTILLABLE COMPONENT TO PRODUCE A SELECTED HYDROGENATED DISTILLABLE LIGHT HYDROCARBONACEOUS PRODUCT

[75] Inventors: Tom N. Kalnes, La Grange; Robert B. James, Jr., Northbrook, both of Ill.

[73] Assignee: UOP, Des Plaines, Ill.

[21] Appl. No.: 232,261

[22] Filed: Aug. 15, 1988

[51] Int. Cl.[4] ..... C10G 49/00; C10G 65/04

[52] U.S. Cl. ..... 208/85; 208/89; 208/94; 208/143; 208/144; 208/177; 208/179; 208/185; 208/262.1; 208/262.5

[58] Field of Search ..... 208/85, 89, 92, 143, 208/144, 100, 103, 107, 67, 95, 262.1, 262.5

[56] References Cited

U.S. PATENT DOCUMENTS

| | | | |
|---|---|---|---|
| 3,224,959 | 12/1965 | Schlinger et al. | 208/95 |
| 3,228,871 | 1/1966 | Schlinger et al. | 208/95 |
| 3,448,039 | 6/1969 | Tarhan | 208/143 |
| 3,992,285 | 11/1976 | Hutchings | 208/208 R |
| 4,029,571 | 6/1977 | Curtin | 208/107 |
| 4,075,084 | 2/1978 | Skripek et al. | 208/92 |
| 4,481,101 | 11/1984 | Yan | 208/107 |
| 4,536,280 | 8/1985 | White et al. | 208/107 |
| 4,548,619 | 10/1985 | Steacy | 208/103 |
| 4,715,947 | 12/1987 | Staggs | 208/67 |
| 4,719,007 | 1/1988 | Johnson et al. | 208/99 |
| 4,747,937 | 5/1988 | Hilfman et al. | 208/216 R |

*Primary Examiner*—Anthony McFarlane

*Attorney, Agent, or Firm*—Thomas K. McBride; John G. Tolomei; John G. Cutts, Jr.

[57] ABSTRACT

A process for treating a temperature-sensitive hydrocarbonaceous stream containing a non-distillable component and a distillable, hydrogenatable hydrocarbonaceous fraction to produce a selected hydrogenated distillable light hydrocarbonaceous product, a distillable heavy hydrocarbonaceous liquid product and a heavy product comprising the non-distillable component while minimizing thermal degradation of the temperature-sensitive hydrocarbonaceous stream which process comprises the steps of: (a) contacting the temperature-sensitive hydrocarbonaceous stream with a hot first hydrogen-rich gaseous stream having a temperature greater than the hydrocarbonaceous stream in a flash zone at flash conditions thereby increasing the temperature of the hydrocarbonaceous stream and vaporizing at least a portion thereof to provide a first hydrocarbonaceous vapor stream comprising hydrogen and a first heavy product stream comprising the non-distillable component; (b) condensing at least a protion of the first hydrocarbonaceous vapor stream to provide a distillable heavy hydrocarbonaceous liquid stream and a second hydrocarbonaceous vapor stream comprising hydrogen and the hydrogenatable, hydrocarbonaceous fraction; (c) contacting the second hydrocarbonaceous vapor stream comprising hydrogen from step (b) with a hydrogenation catalyst in a hydrogenation reaction zone at hydrogenation conditions to increase the hydrogen content of the hydrogenatable hydrocarbonaceous fraction introduced into the hydrogenation reaction zone; (d) condensing at least a portion of the resulting effluent from the hydrogenation zone to provide a second hydrogen-rich gaseous stream and a liquid stream comprising hydrogenated distillable hydrocarbonaceous compounds; and (e) recovering the selected hydrogenated distillable light hydrocarbonaceous product from the liquid stream comprising hydrogenated distilable hydrocarbonaceous compounds.

15 Claims, 1 Drawing Sheet

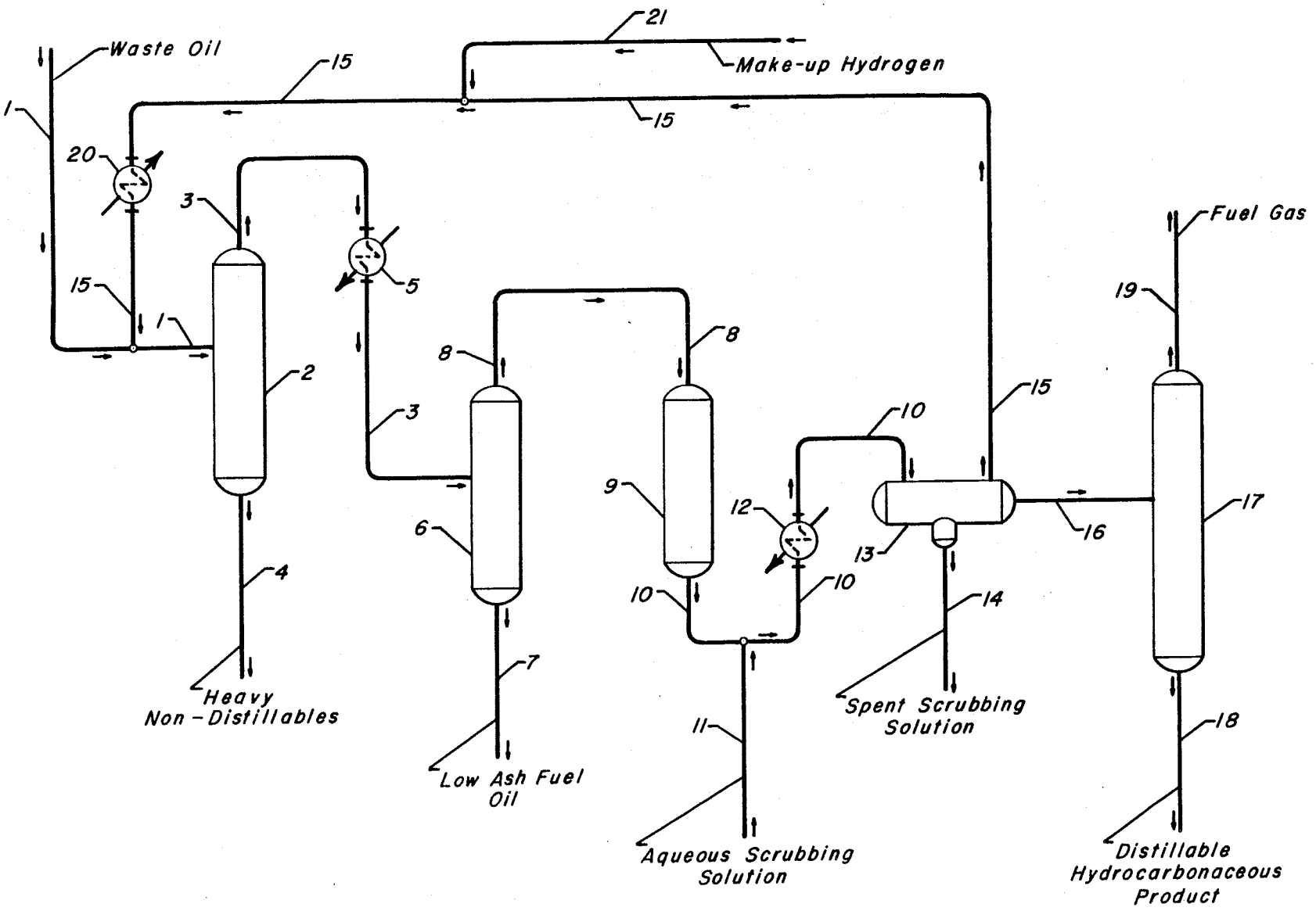
Fuel Gas
Distillable Hydrocarbonaceous Product
Spent Scrubbing Solution
Aqueous Scrubbing Solution
Make-up Hydrogen
Low Ash Fuel Oil
Heavy Non-Distillables
Waste Oil
1
2
3
4
5
6
7
8
9
10
11
12
13
14
15
16
17
18
19
20
21

PROCESS FOR TREATING A TEMPERATURE-SENSITIVE HYDROCARBONACEOUS STREAM CONTAINING A NON-DISTILLABLE COMPONENT TO PRODUCE A SELECTED HYDROGENATED DISTILLABLE LIGHT HYDROCARBONACEOUS PRODUCT

BACKGROUND OF THE INVENTION

The field of art to which this invention pertains is the production of a hydrogenated distillable hydrocarbonaceous product from a temperature-sensitive hydrocarbonaceous stream containing a non-distillable component. More specifically, the invention relates to a process for treating a temperature-sensitive hydrocarbonaceous stream containing a non-distillable component and a distillable, hydrogenatable hydrocarbonaceous fraction to produce a selected hydrogenated distillable light hydrocarbonaceous product, a distillable heavy hydrocarbonaceous liquid product, and a heavy product comprising the non-distillable component while minimizing thermal degradation of the temperature-sensitive hydrocarbonaceous stream which process comprises the steps of: (a) contacting the temperature-sensitive hydrocarbonaceous stream with a hot first hydrogen-rich gaseous stream having a temperature greater than the hydrocarbonaceous stream in a flash zone at flash conditions thereby increasing the temperature of the hydrocarbonaceous stream and vaporizing at least a portion thereof to provide a first hydrocarbonaceous vapor stream comprising hydrogen and a first heavy product stream comprising the non-distillable component; (b) condensing at least a portion of the first hydrocarbonaceous vapor stream to provide a distillable heavy hadrocarbonaceous liquid stream and a second hydrocarbonaceous vapor stream comprising hydrogen and the hydrogenatable, hydrocarbonaceous fraction; (c) contacting the second hydrocarbonaceous vapor stream comprising hydrogen from step (b) with a hydrogenation catalyst in a hydrogenation reaction zone at hydrogenation conditions to increase the hydrogen content of the hydrogenatable hydrocarbonaceous fraction introduced into the hydrogenation reaction zone; (d) condensing at least a portion of the resulting effluent from the hydrogenation zone to provide a second hydrogen-rich gaseous stream and a liquid stream comprising hydrogenated distillable hydrocarbonaceous compounds; and (e) recovering the selected hydrogenated distillable light hydrocarbonaceous product from the liquid stream comprising hydrogenated distillable hydrocarbonaceous compounds.

INFORMATION DISCLOSURE

In U.S. Pat. No 3,992,285 (Hutchings), a process is disclosed for the desulfurization of a hydrocarbonaceous black oil containing sulfur and asphaltic material which comprises preheating the oil by indirect heat exchange to a temperature not in excess of about 550° F., commingling the preheated oil with a steam-containing gas to raise the temperature of the oil to a desulfurization temperature of about 600° F. to about 800° F. and contacting the thus heated oil at hydrocarbon conversion conditions with a desulfurization catalyst.

BRIEF SUMMARY OF THE INVENTION

The invention provides an improved process for the production of a selected hydrogenated distillable light hydrocarbonaceous product from a temperature-sensitive hydrocarbonaceous stream containing a non-distillable component and a distillable, hydrogenatable hydrocarbonaceous fraction by means of contacting the hydrocarbonaceous feed stream with a hot first hydrogen-rich gaseous stream to increase the temperature of the feed stream to vaporize at least a portion of the distillable hydrogenatable hydrocarbonaceous fraction. The resulting first vaporous hydrocarbonaceous stream comprising distillable, hydrogenatable hydrocarbonaceous fraction is then partially condensed to provide a distillable liquid hydrocarbonaceous stream and a second hydrocarbonaceous vapor stream comprising hydrogen and the hydrogenatable hydrocarbonaceous fraction which is immediately hydrogenated in an integrated hydrogenation zone. Important elements of the improved process are the relatively short time that the feed stream is maintained at elevated temperature, the avoidance of heating the feed stream via indirect heat exchange to preclude the coke formation that could otherwise occur, the partial condensation of the heavier portion of the distillable hydrocarbonaceous fraction to avoid passing undesirable components over the hydrogenation catalyst, the minimization of utility costs due to the integration of the hydrogenation zone and the opportunity to only hydrogenate the desired hydrogenatable hydrocarbons while simultaneously producing a distillable heavy hydrocarbonaceous liquid stream which is not required to be hydrogenated.

One embodiment of the invention may be characterized as a process for treating a temperature-sensitive hydrocarbonaceous stream containing a non-distillable component and a distillable, hydrogenatable hydrocarbonaceous fraction to produce a selected hydrogenated distillable light hydrocarbonaceous product, a distillable heavy hydrocarbonaceous liquid product and a heavy product comprising the non-distillable component while minimizing thermal degradation of the temperature-sensitive hydrocarbonaceous stream which process comprises the steps of: (a) contacting the temperature-sensitive hydrocarbonaceous stream with a hot first hydrogen-rich gaseous stream having a temperature greater than the hydrocarbonaceous stream in a flash zone at flash conditions thereby increasing the temperature of the hydrocarbonaceous stream and vaporizing at least a portion thereof to provide a first hydrocarbonaceous vapor stream comprising hydrogen and a first heavy product stream comprising the non-distillable component; (b) condensing at least a portion of the first hydrocarbonaceous vapor stream to provide a distillable heavy hydrocarbonaceous liquid stream and a second hydrocarbonaceous vapor stream comprising hydrogen and the hydrogenatable, hydrocarbonaceous fraction; (c) contacting the second hydrocarbonaceous vapor stream comprising hydrogen from step (b) with a hydrogenation catalyst in a hydrogenation reaction zone at hydrogenation conditions to increase the hydrogen content of the hydrogenatable hydrocarbonaceous fraction introduced into the hydrogenation reaction zone; (d) condensing at least a portion of the resulting effluent from the hydrogenation zone to provide a second hydrogen-rich gaseous stream and a liquid stream comprising hydrogenated distillable hydrocarbonaceous compounds; and (e) recovering the selected hydrogenated distillable light hydrocarbonaceous product from the liquid stream comprising hydrogenated distillable hydrocarbonaceous compounds.

Another embodiment of the invention may be characterized as a process for treating a temperature-sensitive hydrocarbonaceous stream containing a non-distillable component and a distillable, hydrogenatable hydrocarbonaceous fraction to produce a selected hydrogenated distillable light hydrocarbonaceous product, a distillable heavy hydrocarbonaceous liquid product and a heavy product comprising the non-distillable component while minimizing thermal degradation of the temperature-sensitive hydrocarbonaceous stream which process comprises the steps of: (a) contacting the temperature-sensitive hydrocarbonaceous stream with a hot first hydrogen-rich gaseous stream having a temperature greater than the hydrocarbonaceous stream in a flash zone at flash conditions thereby increasing the temperature of the hydrocarbonaceous stream and vaporizing at least a portion thereof to provide a first hydrocarbonaceous vapor stream comprising hydrogen and a first heavy product stream comprising the non-distillable component; (b) condensing at least a portion of the first hydrocarbonaceous vapor stream to provide a distillable heavy hydrocarbonaceous liquid stream and a second hydrocarbonaceous vapor stream comprising hydrogen and the hydrogenatable, hydrocarbonaceous fraction; (c) contacting the second hydrocarbonaceous vapor stream comprising hydrogen from step (b) with a hydrogenation catalyst in a hydrogenation reaction zone at hydrogenation conditions to increase the hydrogen content of the hydrogenatable hydrocarbonaceous fraction introduced into the hydrogenation reaction zone; (d) condensing at least a portion of the resulting effluent from the hydrogenation zone to provide a second hydrogen-rich gaseous stream and a liquid stream comprising hydrogenated distillable hydrocarbonaceous compounds; and (e) flashing the liquid stream comprising hydrogenated distillable hydrocarbonaceous compounds to provide a gaseous stream comprising hydrogen and normally gaseous hydrocarbons, and the selected hydrogenated distillable light hydrocarbonaceous product.

Other embodiments of the present invention encompass further details such as preferred feedstocks, hydrogenation catalysts, aqueous scrubbing solutions and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

There is a steadily increasing demand for technology which is capable of treating a temperature-sensitive hydrocarbonaceous stream containing a non-distillable component and a distillable hydrogenatable hydrocarbonaceous fraction to produce a selected hydrogenated distillable light hydrocarbonaceous product, a distillable heavy hydrocarbonaceous liquid product and a heavy non-distillable product while minimizing thermal degradation of the hydrocarbonaceous feed stream. Such treatment has always been in demand for the preparation and production of various hydrocarbonaceous products but with the increased environmental emphasis for the treatment and recycle of waste hydrocarbonaceous products there is an increased need for improved processes to separate heavy non-distillable components from a distillable hydrogenatable hydrocarbonaceous fraction which may then be hydrogenated. For example, during the disposal or recycle of potentially environmentally harmful hydrocarbonaceous waste streams, an important step in the total solution to the problem is the pretreatment or conditioning of a hydrocarbonaceous stream which facilitates the ultimate resolution to provide product streams which may subsequently be handled in an environmentally acceptable manner. Therefore, those skilled in the art have sought to find feasible techniques to remove heavy non-distillable components from a temperature-sensitive hydrocarbonaceous stream to provide a distillable hydrogenatable hydrocarbonaceous fraction which may then be hydrogenated. Previous techniques which have been employed include filtration, vacuum wiped film evaporation, centrifugation, and vacuum distillation.

The present invention provides an improved integrated process for the removal of heavy non-distillable components from a temperature-sensitive hydrocarbonaceous stream and the subsequent hydrogenation of a distillable, hydrogenatable hydrocarbonaceous fraction. The present invention is particularly advantageous when the distillable portion of the charge stock contains only a relatively small fraction of hydrocarbonaceous compounds which are desired to be hydrogenated while simultaneously producing a heavy product stream containing the non-distillable component of the temperature sensitive charge stock. A wide variety of temperature-sensitive hydrocarbonaceous streams are to be candidates for feed streams in accordance with the process of the present invention. Examples of hydrocarbonaceous streams which are suitable for treatment by the process of the present invention are dielectric fluids, hydraulic fluids, heat transfer fluids, used lubricating oil, used cutting oils, used solvents, still bottoms from solvent recycle operations, coal tars, atmospheric residuum, oils contaminated with polychlorinated biphenyls (PCB), halogenated wastes and other hydrocarbonaceous industrial waste. Many of these hydrocarbonaceous streams may contain non-distillable components which include, for example, organometallic compounds, inorganic metallic compounds, finely divided particulate matter and non-distillable hydrocarbonaceous compounds. The present invention is particularly advantageous when the non-distillable components comprise sub-micron particulate matter and the conventional techniques of filtration or centrifugation tend to be highly ineffective.

The presence of a non-distillable component including finely divided particulate matter in a hydrocarbonaceous feed to a hydrogenation zone greatly increases the difficulty of the hydrogenation. A non-distillable component tends (1) to foul the hot heat exchange surfaces which are used to heat the feed to hydrogenation conditions, (2) to form coke or in some other manner deactivate the hydrogenation catalyst thereby shortening its active life and (3) to otherwise hinder a smooth and facile hydrogenation operation. Particulate matter in a feed stream tends to deposit within the hydrogenation zone and to plug a fixed hydrogenation catalyst bed thereby abbreviating the time on stream.

In accordance with the present invention, the capacity of the hydrogenation zone may be selected in order to economically and efficiently hydrogenate only a selected fraction of the distillable portion of the temperature-sensitive charge stock.

Once the temperature-sensitive hydrocarbonaceous feed stream is separated into a distillable hydrocarbonaceous stream and a heavy non-distillable product, the resulting distillable hydrocarbonaceous stream is partially condensed to provide vaporous hydrogenatable hydrocarbonaceous fraction which is introduced into a hydrogenation zone. If the feed stream contains metallic compounds comprising zinc, copper, iron, barium, phosphorus, magnesium, aluminum, lead, mercury, cadmium, cobalt, arsenic, vanadium, chromium, and nickel, these compounds will be isolated in the relatively small volume of recovered non-distillable product which may then be treated for metals recovery or otherwise disposed of as desired. In the event that the feed stream contains distillable hydrocarbonaceous compounds which include sulfur, oxygen, nitrogen, metal or halogen components, a portion of the resulting recovered distillable hydrocarbonaceous stream is hydrogenated to remove or convert such components as desired. In a preferred embodiment of the present invention, the hydrogenation of a portion of the resulting distillable hydrocarbonaceous stream is preferably conducted immediately without intermediate separation or condensation. The advantages of the integrated process of the present invention will be readily apparent to those skilled in the art and include the economy of greatly reduced utility costs.

In accordance with the subject invention, a temperature-sensitive hydrocarbonaceous stream containing a non-distillable component is contacted with a first hot hydrogen-rich gaseous stream having a temperature greater than the hydrocarbonaceous stream in a flash zone at flash conditions thereby increasing the temperature of the hydrocarbonaceous stream and vaporizing a portion thereof to provide a hydrocarbonaceous vapor stream comprising hydrogen and a heavy stream comprising the non-distillable component. The hydrocarbonaceous vapor stream comprising hydrogen from the flash zone is partially condensed to provide a distillable heavy hydrocarbonaceous liquid stream and a second hydrocarbonaceous vapor stream comprising hydrogen and hydrogenatable hydrocarbonaceous compounds. The hot hydrogen-rich gaseous stream preferably comprises more than about 70 mole % hydrogen and more preferably more than about 90 mole % hydrogen. The hot hydrogen-rich gaseous stream is multi-functional and serves as (1) a heat source used to directly heat the hydrocarbonaceous feed stream to preclude the coke formation that could otherwise occur when using an indirect heating apparatus such as a heater or heat-exchanger, (2) a diluent to reduce the partial pressure and residence time of the hydrocarbonaceous compounds during vaporization in the flash zone, (3) a possible reactant to minimize the formation of hydrocarbonaceous polymers at elevated temperatures, (4) a stripping medium and (5) at least a portion of the hydrogen required in the hydrogenation reaction zone. In accordance with the subject invention, the temperature-sensitive hydrocarbonaceous feed stream is preferably maintained at a temperature less than about 580° F. (304° C.) and more preferably less than about 482° F. (250° C.) before being introduced into the flash zone in order to prevent or minimize the thermal degradation of the feed stream. Depending upon the characteristics and composition of the hydrocarbonaceous feed stream, the hot hydrogen-rich gaseous stream is introduced into the flash zone at a temperature greater than the hydrocarbonaceous feed stream to the flash zone and preferably at a temperature from about 100° F. (38° C.) to about 1200° F. (649° C.).

During the contacting, the flash zone is preferably maintained at flash conditions which include a temperature from about 100° F. (38° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m^3/m^3$) based on the temperature-sensitive hydrocarbonaceous feed stream entering the flash zone and an average residence time of the hydrogen-containing, hydrocarbonaceous vapor stream in the flash zone from about 0.1 seconds to about 50 seconds. A more preferred average residence time of the hydrogen-containing, hydrocarbonaceous vapor stream in the flash zone is, from about 1 second to about 10 seconds.

Although the preferred operating temperature of the flash zone ranges from about 100° F. (38° C.) to about 860° F. (460° C. ), it is essential for the intended performance of the present invention that the vaporous hydrocarbonaceous stream from the flash zone be cooled to a temperature less than in the flash zone in order to condense at least a portion of the distillable hydrocarbonaceous compounds to provide a liquid phase distillable heavy hydrocarbonaceous stream. The partial condensation serves to isolate the desired vaporous hydrocarbonaceous stream to be hydrogenated and to minimize the passage of undesirable high molecular weight components to the catalytic hydrogenation zone. The partial condensation enables the hydrogenation of only a selected portion of the feed stream. Another advantage of the present invention is to eliminate downstream admixing of an alkaline aqueous solution, if used, with heavy distillable hydrocarbonaceous fractions and which admixture may form undesirable emulsions. The uncondensed distillable hydrocarbonaceous compounds and hydrogen are directly introduced without subsequent separation thereof into a hydrogenation reaction zone. The pressure of the flash zone is preferably coordinated with the pressure of the hydrogenation reaction zone so that the hydrogenatable hydrocarbonaceous compounds flow without intermediate separation and pumping into the hydrogenation reaction zone.

In accordance with the present invention, the term "distillable light hydrocarbonaceous product" is defined as having a mean boiling range temperature of less than the mean boiling range temperature of the stream defined by the term "distillable heavy hydrocarbonaceous liquid". The preparation of these streams is described herein.

The resulting heavy non-distillable portion of the feed stream is removed from the bottom of the flash zone as required to yield a heavy non-distillable product. The heavy non-distillable product may contain a relatively small amount of distillable components but since essentially all of non-distillable components contained in the hydrocarbonaceous feed stream are recovered in this product stream, the term "heavy non-distillable product" is nevertheless used for the convenient description of this product stream. The heavy non-distillable product preferably contains a distillable component of less than about 50 weight percent and more preferably less than about 25 weight percent. Under certain circumstances with a feed stream not having an appreciable amount of liquid non-distillable components, it is contemplated that an additional liquid may be utilized to flush the heavy non-distillables from the flash zone. An example of this situation is when the hydrocarbonaceous feed stream comprises a very high percentage of distillable hydrocarbonaceous compounds and relatively small quantities of finely divided particulate matter (solid) and essentially no liquid non-distillable component for use as a carrier for the solids. Such a flush liquid may, for example, be a high boiling range vacuum gas oil having a boiling range from about 700° F. (371° C.) to about 1000° F. (538° C.) or a vacuum tower bottoms stream boiling at a temperature greater than about 1000° F. (538° C.). The selection of a flush liquid depends upon the completion of the hydrocarbonaceous feed stream and the prevailing flash conditions in the flash separator, and the volume of the flush liquid is preferably limited to that required for removal of the heavy non-distillable component.

The resulting hydrogen-containing, hydrogenatable hydrocarbonaceous vapor stream is introduced into a catalytic hydrogenation zone containing hydrogenation catalyst and maintained at hydrogenation conditions. The catalytic hydrogenation zone may contain a fixed, ebullated or fluidized catalyst bed. This reaction zone is preferably maintained under an imposed pressure from about atmospheric (0 kPa gauge) to about 2000 psig (13790 kPa gauge) and more preferably under a pressure from about 100 psig (689.5 kPa gauge) to about 1800 psig (12411 kPa gauge). Suitably, such reaction is conducted with a maximum catalyst bed temperature in the range of about 122° F. (50° C.) to about 850° F. (454° C.) selected to perform the desired hydrogenation conversion to reduce or eliminate the undesirable characteristics or components of the hydrogenatable hydrocarbonaceous vapor stream. In accordance with the present invention, it is contemplated that the desired hydrogenation conversion includes, for example, dehalogenation, desulfurization, denitrification, olefin saturation, oxygenate conversion and hydrocracking. Further preferred operating conditions include liquid hourly space velocities in the range from about 0.05 $hr^{-1}$ to about 20 $hr^{-1}$ and hydrogen circulation rates from about 200 standard cubic feet per barrel (SCFB) (33.71 normal $m^3/m^3$) to about 50,000 SCFB (8427 normal $m^3/m^3$), preferably from about 300 SCFB (50.6 normal $m^3/m^3$) to about 20,000 SCFB (3371 normal $m^3/m^3$).

In the event that the temperature of the vaporous hydrogen-containing, hydrogenatable hydrocarbonaceous stream is not deemed to be exactly the temperature selected to operate the catalytic hydrogenation zone, we contemplate that the temperature of the vaporous hydrogen-containing, hydrogenatable hydrocarbonaceous stream may be adjusted either upward or downward in order to achieve the desired temperature in the catalytic hydrogenation zone. Such a temperature adjustment may be accomplished, for example, by indirect heat exchange or by the addition of either cold or hot hydrogen.

The preferred catalytic composite disposed within the hereinabove described hydrogenation zone can be characterized as containing a metallic component having hydrogenation activity, which component is combined with a suitable refractory carrier material of either synthetic or natural origin. The precise composition and method of manufacturing the carrier material is not considered essential to the present invention. Preferred carrier materials are alumina, silica, carbon and mixtures thereof. Suitable metallic components having hydrogenation activity are those selected from the group comprising the metals of Groups VI-B and VIII of the Periodic Table, as set forth in the *Periodic Table of the Elements*, E. H. Sargent and Company, 1964. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically active metallic component, or components, is primarily dependent upon a particular metal as well as the physical and/or chemical characteristics of the particular hydrocarbon feedstock. For example, the metallic components of Group VI-B are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. It is further contemplated that hydrogenation catalytic composites may comprise one or more of the following components: cesium, francium, lithium, potassium, rubidium, sodium, copper, gold, silver, cadmium, mercury and zinc.

The hydrocarbonaceous effluent from the hydrogenation zone is preferably contacted with an aqueous scrubbing solution and the mixture is admitted to a separation zone in order to separate a spent aqueous stream, a hydrogenated hydrocarbonaceous liquid phase and a hydrogen-rich gaseous phase. The contact of the hydrocarbonaceous effluent from the hydrogenation zone with the aqueous scrubbing solution may be performed in any convenient manner and is preferably conducted by co-current, in-line mixing which may be promoted by inherent turbulence, mixing orifices or any other suitable mixing means. The aqueous scrubbing solution is preferably introduced in an amount from about 1 to about 100 volume percent based on the hydrocarbonaceous effluent from the hydrogenation zone. The aqueous scrubbing solution is selected depending on the characteristics of the hydrocarbonaceous feed stream introduced into the hydrogenation zone. For example, if the hydrocarbonaceous feed stream to the hydrogenation zone comprises halogenated compounds, the aqueous scrubbing solution preferably contains a basic compound such as calcium hydroxide, potassium hydroxide or sodium hydroxide in order to neutralize the acid such as hydrogen chloride, hydrogen bromide and hydrogen fluoride, for example, which is formed during the hydrogenation of the halogen compounds. In the event that the hydrocarbonaceous feed stream contains only sulfur and nitrogen compounds, water may be a suitable aqueous scrubbing solution to dissolve the resulting hydrogen sulfide and ammonia. The resulting hydrogenated hydrocarbonaceous liquid phase is recovered and the hydrogen-rich gaseous phase may be recycled to the flash zone if desired.

The resulting hydrogenated hydrocarbonaceous liquid phase is preferably recovered from the hydrogen-rich gaseous phase in a separation zone which is maintained at essentially the same pressure as the hydrogenation reaction zone and as a consequence contains dissolved hydrogen and low molecular weight normally gaseous hydrocarbons if present. In accordance with the present invention, it is preferred that the hydrogenated hydrocarbonaceous liquid phase comprising the hereinabove mentioned gases be stabilized in a convenient manner, such as, for example, by stripping or flashing to remove the normally gaseous components to provide a stable hydrogenated distillable hydrocarbonaceous product.

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous appurtenances are well within the purview of one skilled in the art.

With reference now to the drawing, a liquid hydrocarbonaceous feed stream having a non-distillable component and a distillable hydrogenatable hydrocarbonaceous fraction is introduced into the process via conduit 1 and is contacted with a hot gaseous hydrogen-rich recycle stream which is provided via conduit 15 and hereinafter described. The liquid hydrocarbonaceous feed stream and the hot hydrogen-rich recycle stream are intimately contacted and introduced into hot hydrogen separator 2. A distillable hydrocarbonaceous vapor stream comprising hydrogen and a hydrogenatable hydrocarbonaceous fraction is removed from hot hydrogen separator 2 via conduit 3 and introduced into cooler 5 for partial condensation and then introduced via conduit 3 into vapor/liquid separator 6. A heavy non-distillable stream is removed from the bottom of hot hydrogen separator 2 via conduit 4 and recovered. A distillable vaporous hydrocarbonaceous stream comprising a hydrogenatable hydrocarbonaceous fraction is recovered from vapor/liquid separator 6 via conduit 8 and is introduced into hydrogenation reaction zone 9 via conduit 8. A distillable heavy hydrocarbonaceous liquid stream is removed from vapor/liquid separator 6 via conduit 7 and recovered. This recovered distillable heavy hydrocarbonaceous liquid stream may be subsequently stabilized to remove dissolved hydrogen and light hydrocarbonaceous gases in equipment and vessels not shown. The resulting hydrogenated hydrocarbonaceous stream is removed from hydrogenation reaction zone 9 via conduit 10 and is contacted with an aqueous scrubbing solution which is introduced via conduit 11. The resulting admixture of the hydrogenated hydrocarbonaceous effluent and the aqueous scrubbing solution is passed via conduit 10 and cooled in heat-exchanger 12. The resulting cooled effluent from heat-exchanger 12 is passed via conduit 10 into high pressure vapor/liquid separator 13. A hydrogen-rich gaseous stream is removed from high pressure vapor/liquid separator 13 via conduit 15, heated to a suitable temperature in heat exchanger 20 and utilized to contact the waste oil feed stream as hereinabove described. Since hydrogen is lost in the process by means of a portion of the hydrocarbon being dissolved in the exiting liquid hydrocarbon and hydrogen being consumed during the hydrogenation reaction, it is necessary to supplant the hydrogen-rich gaseous stream with make-up hydrogen from some suitable external source, for example, a catalytic reforming unit or a hydrogen plant. Make-up hydrogen may be introduced into the system at any convenient and suitable point, and is introduced in the drawing via conduit 21. A liquid hydrogenated hydrocarbonaceous stream comprising hydrogen in solution is removed from high pressure vapor/liquid separator 13 via conduit 16 and is introduced into low pressure vapor/liquid separator 17. A spent aqueous scrubbing solution is removed from high pressure vapor/liquid separator 13 via conduit 14 and recovered. A gaseous stream comprising hydrogen and any normally gaseous hydrocarbons present is removed from low pressure vapor/liquid separator 17 via conduit 19 and recovered. A normally liquid distillable hydrogenated light hydrocarbonaceous product is removed from low pressure vapor/liquid separator 17 via conduit 18 and recovered. In the event that the waste oil feed stream contains water, this water is recovered from high pressure vapor/liquid separator 13 via conduit 14 together with the spent aqueous scrubbing solution as hereinabove described.

The following example is presented for the purpose of further illustrating the process of the present invention, and to indicate the benefits afforded by the utilization thereof in producing a distillable hydrogenated hydrocarbonaceous product while minimizing thermal degradation of the temperature-sensitive hydrocarbonaceous feed stream containing a non-distillable component.

EXAMPLE

A waste oil stream is selected for processing in accordance with the process of the present invention and has the characteristics as presented in Table 1.

TABLE 1

| WASTE OIL ANALYSIS | | |
|---|---|---|
| Specific Gravity @ 60° F. (15° C.) | | 0.907 |
| Distillation, °F. (°C.) (D-1160) | | |
| IBP | 198 | (92) |
| 50% | 741 | (394) |
| EP | 957 | (514) |
| % Over | 88 | |
| % Residue | 12 | |
| Emulsified Water, weight percent | 19 | |
| Ash, weight percent | 1.15 | |
| Metals, weight percent | 0.41 | |

The waste oil stream primarily contains used lubricating oil contaminated with emulsified water, trace quantities of chlorinated degreasing solvent which are concentrated in the 600° F. (315° C.)—minus boiling range fraction and trace quantities of heavy metals which are concentrated in the non-distillable residual fraction and is pumped to a flash zone at a temperature of 482° F. (250° C.) and contacted with hot hydrogen in order to maintain flash zone conditions at a pressure of 500 psig (3447 kPa gauge), a temperature of 750° F. (399° C.) and a hydrogen to oil ratio of about 20,000 standard cubic feet per barrel (SCFB) (3370 normal $m^3/m^3$). The flash zone produces a hydrocarbonaceous vapor stream comprising hydrogen, chlorinated degreasing solvent and water vapor which stream contains about 90 volume percent of the waste oil feedstock and the hydrocarbon fraction of this stream has a specific gravity at 60° F. (15° C.) of 0.87.

The hydrocarbonaceous vapor stream from the flash zone is cooled to a temperature of about 500° F. (260° C.) and is introduced into a vapor/liquid separation zone which is maintained at a pressure of 490 psig (3378 kPa gauge) and a temperature of 450° F. (232° C.) to produce an overhead vapor stream in an amount of about 30 volume percent of the waste oil feedstock and a condensed, distillable liquid hydrocarbonaceous stream in an amount of about 60 volume percent of the waste oil feedstock. The resulting vaporous overhead stream is introduced into a catalytic hydrogenation zone which is operated at a pressure of about 485 psig (3344 kPa gauge) and a temperature of about 600° F.

(315° C.) with a hydrogen to feed ratio of about 50,000 SCFB (8427 normal $m^3/m^3$). The hydrogenated hydrocarbonaceous product recovered from the catalytic hydrogenation zone is analyzed and the results are presented in Table 2. Approximately 10 volume percent of the original waste oil left the flash zone as a non-distillable residue. The majority, 99+% of the ash present in the original waste oil left the process with the non-distillable residue stream.

TABLE 2

SUMMARY OF RESULTS

| | Hydrocarbon Stream | | | | | |
|---|---|---|---|---|---|---|
| | 1 | 2 | 3 | 4 | 5 | 6 |
| Description | Waste Oil | Distillable Hydrocarbon From 1st Flash | Distillable Liquid Hydrocarbon From Partial Condenser | Hydrocarbon to Hydrogenation | Hydrogenation Zone Product | Non-Distillable |
| Specific Gravity 60° F. (15° C.) | 0.9072 | 0.87 | 0.88 | 0.84 | 0.825 | ~1.1 |
| Sulfur Weight Percent | 0.23 | 0.25 | 0.22 | 0.5 | <0.01 | |
| Chloride Weight Percent | 0.2 | 0.22 | <0.05 | 1.3 | <0.01 | |
| D-1160 Distillation, °F. (°C.) | | | | | | |
| IBP | 198 (97) | 140 (60) | 590 | 140 (60) | 140 (60) | |
| 10 | 216 (102) | | | | | |
| 30 | 651 (344) | | | | | |
| 50 | 741 (394) | 730 (387) | 784 | 485 (252) | 480 (249) | |
| 70 | 806 (429) | | | | | |
| 90 | | | | | | |
| EP | 957 (514) | 1050 (565) | 1050 | 680 (360) | 685 (363) | |
| % Over | 88 | 99 | 99 | 98 | 99 | |
| % Residue | 12 | 1 | 1 | 2 | | |

The forgoing description, drawing and example clearly illustrate the advantages encompassed by the process of the present invention and the benefits to be afforded with the use thereof.

We claim:

1. A process for treating a temperature-sensitive hydrocarbonaceous stream containing a non-distillable component and a distillable, hydrogenatable hydrocarbonaceous fraction to produce a selected hydrogenated distillable light hydrocarbonaceous product, a distillable heavy hydrocarbonaceous product and a heavy product comprising said non-distillable component while minimizing thermal degradation of said temperature-sensitive hydrocarbonaceous stream which process comprises the steps of:

(a) contacting said temperature-sensitive hydrocarbonaceous stream with a hot first hydrogen-rich gaseous stream having a temperature greater than said hydrocarbonaceous stream in a flash zone at flash conditions thereby increasing the temperature of said hydrocarbonaceous stream and vaporizing at least a portion thereof to provide a first hydrocarbonaceous vapor stream comprising hydrogen and a first heavy product stream comprising said non-distillable component;

(b) condensing at least a portion of said first hydrocarbonaceous vapor stream to provide a distillable heavy hydrocarbonaceous liquid stream and a second hydrocarbonaceous vapor stream comprising hydrogen and said hydrogenatable, hydrocarbonaceous fraction;

(c) contacting said second hydrocarbonaceous vapor stream comprising hydrogen from step (b) with a hydrogenation catalyst in a hydrogenation reaction zone at hydrogenation conditions to increase the hydrogen content of said hydrogenatable hydrocarbonaceous fraction introduced into said hydrogenation reaction zone;

(d) condensing at least a portion of the resulting effluent from said hydrogenation zone to provide a second hydrogen-rich gaseous stream and a liquid stream comprising hydrogenated distillable hydrocarbonaceous compounds; and (e) recovering said selected hydrogenated distillable light hydrocarbonaceous product from said liquid stream comprising hydrogenated distillable hydrocarbonaceous compounds.

2. The process of Claim 1 wherein said second hydrogen-rich gaseous stream recovered in step (d) is recycled to step (a).

3. The process of Claim 1 wherein said temperature-sensitive hydrocarbonaceous stream comprises a component selected from the group consisting of dielectric fluids, hydraulic fluids, heat transfer fluids, used lubricating oil, used cutting oils, used solvents, still bottoms from solvent recycle operations, coal tars, atmospheric residuum, halogenated wastes and mixtures thereof.

4. The process of Claim 1 wherein said non-distillable component comprises organometallic compounds, inorganic metallic compounds, finely divided particulate matter or non-distillable hydrocarbonaceous compounds.

5. The process of Claim 1 wherein said temperature-sensitive hydrocarbonaceous stream is introduced into said flash zone at a temperature less than about 580° F. (304° C.).

6. The process of Claim 1 wherein the temperature of said hot hydrogen-rich stream is from about 100° F. (38° C.) to about 1200° F. (649° C.)

7. The process of Claim 1 wherein said flash conditions include a temperature from about 100° F. (38° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m^3/m^3$) based on said temperature-sensitive hydrocarbonaceous stream, and an average residence time of said hydrocarbonaceous vapor stream comprising hydrogen in said flash zone from about 0.1 seconds to about 50 seconds.

8. The process of Claim 1 wherein said hydrocarbonaceous stream comprises halogenated hydrocarbons or organometallic compounds.

9. A process of Claim 1 wherein said hydrogenation reaction zone is operated at conditions which include a pressure from about atmospheric (0 kPa gauge) to about 2000 psig (13790 kPa gauge), a maximum catalyst temperature from about 122° F. (50° C.) to about 850° F. (454° C.) and a hydrogen circulation rate from about 200 SCFB (33.7 normal $m^3/m^3$) at about 50,000 SCFB (8427 normal $m^3/m^3$).

10. The process of Claim 1 wherein said hydrogenation catalyst comprises a refractory inorganic oxide and at least one metallic compound having hydrogenation activity.

11. The process of Claim 10 wherein said metallic compound is selected from the metals of Group VIB and VIII of the Periodic Table.

12. The process of Claim 1 wherein said effluent from said hydrogenation zone is contacted with an aqueous scrubbing solution to dissolve at least a portion of an inorganic compound produced in said hydrogenation reaction zone.

13. The process of Claim 12 wherein said aqueous scrubbing solution contains a basic compound.

14. The process of Claim 13 wherein said basic compound is selected from the group consisting of calcium hydroxide, potassium hydroxide and sodium hydroxide.

15. A process for treating a temperature-sensitive hydrocarbonaceous stream containing a non-distillable component and a distillable, hydrogenatable hydrocarbonaceous fraction to produce a selected hydrogenated distillable light hydrocarbonaceous product, a distillable heavy hydrocarbonaceous liquid product and a heavy product comprising said non-distillable component while minimizing thermal degradation of said temperature-sensitive hydrocarbonaceous stream which process comprises the steps of:

(a) contacting said temperature-sensitive hydrocarbonaceous stream with a hot first hydrogen-rich gaseous stream having a temperature greater than said hydrocarbonaceous stream in a flash zone at flash conditions thereby increasing the temperature of said hydrocarbonaceous stream and vaporizing at least a portion thereof to provide a first hydrocarbonaceous vapor stream comprising hydrogen and a first heavy product stream comprising said non-distillable component;

(b) condensing at least a portion of said first hydrocarbonaceous vapor stream to provide a distillable heavy hydrocarbonaceous liquid stream and a second hydrocarbonaceous vapor stream comprising hydrogen and said hydrogenatable, hydrocarbonaceous fraction;

(c) contacting said second hydrocarbonaceous vapor stream comprising hydrogen from step (b) with a hydrogenation catalyst in a hydrogenation reaction zone at hydrogenation conditions to increase the hydrogen content of said hydrogenatable hydrocarbonaceous fraction introduced into said hydrogenation reaction zone;

(d) condensing at least a portion of the resulting effluent from said hydrogenation zone to provide a second hydrogen-rich gaseous stream and a liquid stream comprising hydrogenated distillable hydrocarbonaceous compounds; and (e) flashing said liquid stream comprising hydrogenated distillable hydrocarbonaceous compounds to provide a gaseous stream comprising hydrogen and normally gaseous hydrocarbons, and said selected hydrogenated distillable light hydrocarbonaceous product.

* * * * *